US005354126A

United States Patent [19]

Pedrego

[11] Patent Number: 5,354,126

[45] Date of Patent: Oct. 11, 1994

[54] EARTHQUAKE-RESISTANT PROTECTIVE ENCLOSURE

[76] Inventor: Albert Pedrego, 1450 Locust Ave. Unit 105, Long Beach, Calif. 90813

[21] Appl. No.: 1,749

[22] Filed: Jan. 7, 1993

[51] Int. Cl.[5] ..... A47B 83/00

[52] U.S. Cl. ..... 312/237; 52/167 R

[58] Field of Search ..... 27/6, 15; 312/235.2, 312/235.3, 237, 293.1, 310; 109/49.5, 15, 1 V; 52/167, 79.1, 79.7, 79.9

[56] References Cited

U.S. PATENT DOCUMENTS

| | | | |
|---|---|---|---|
| 616,149 | 12/1898 | Semmens et al. | 27/15 |
| 3,233,302 | 2/1966 | Ross | 27/6 |
| 4,027,601 | 6/1977 | Hickerson | 108/49.5 |
| 4,490,864 | 1/1985 | Wicker | 52/167 R |

FOREIGN PATENT DOCUMENTS

| | | | |
|---|---|---|---|
| 0095615 | 2/1960 | Netherlands | 312/235.2 |
| 0025445 | 11/1912 | United Kingdom | 312/310 |

*Primary Examiner*—Kenneth J. Dorner
*Assistant Examiner*—Gerald A. Anderson
*Attorney, Agent, or Firm*—Erik M. Arnhem

[57] ABSTRACT

A protective enclosure for a human being is constructed of a series of rigid panels resistant to earthquake forces. A person can crawl into the enclosure through an access opening, after which the person can pull a flexible roll-type door downwardly across the access opening to achieve a protective housing fully surrounding the person. Interior surfaces of the enclosure are lined with a resilient cushions material so that if the person's body should impact the housing interior surfaces the impact forces will be at least partially absorbed or relieved by the cushioner material. The enclosure includes compartments for storage of emergency items, such as a flashlight or a battery-operated beeper usable to alert persons in the general area that a person is within the enclosure.

13 Claims, 3 Drawing Sheets

EARTHQUAKE-RESISTANT PROTECTIVE ENCLOSURE

BACKGROUND OF THE INVENTION

1. Field of the Invention

This invention relates to an earthquake-resistant protective enclosure for a human being. In its preferred form the enclosure is constructed as an integral part of a furniture item, e.g. a desk or table.

2. Prior Developmens

U.S. Pat. No. 4,782,541, issued to David Tuchman on Nov. 8, 1988, discloses a bed construction designed to protect the bed occupant from falling debris that might be generated during an earthquake. A steel mesh canopy is supported by four corner posts that telescope into four tubular legs constituting part of the bed frame work; coil springs are located within the tubular legs so that if heavy debris should fall onto the canopy the coil springs can resiliently support the debris-laden canopy, thereby protecting the person lying on the bed.

U.S. Pat. No. 4,490,864, granted to Roy Wicker on Jan. 1, 1985 discloses a sleeping bed having steel skirting anchored to the floor of a room to form a sheltered space beneath the mattress-support platform. A person can roll or slide along the room floor into the sheltered space for protection during a tornado or hurricane.

U.S. Pat. No. 2,607,047, issued to Frank Posey on Aug. 19, 1952, shows a combination bed and shelter designed to protect human beings during an air raid or earthquake. The bed frame comprises a horizontal platform that includes a layer of concrete sandwiched between upper and lower panels, to provide protection against falling debris. The space below the platform is enclosed by an array of higned closures. The space within the defined enclosure contains upper and lower mattresses that can be accessed by opening the hinged closures.

SUMMARY OF THE INVENTION

The present invention is directed to a protective enclosure for a single human being during an earthquake. The enclosure is preferably constructed as an integral part of an item of furniture, e.g. a kneehole desk or a table.

In its preferred form the protective enclosure comprises a rectangular housing defined by a series of flat earthquake-resistant panels; the panels may be rigidly connected together by welding or by dowels and screws. One face of the rectangular housing is left open for human access purposes; a flexible roll top door spans the access opening for shielding the person while he or she is within the housing.

Interior surfaces of the housing are lined with a resilient cushioner material, so that if the housing should overturn or shift suddenly, the body of the person within the housing will strike a relatively soft padded surface rather than a hard non-resilient surface.

The housing will preferably include one or more compartments for containment of emergency items, e.g. a flashlight, a battery-operated beeper, first aid supplies, matches, water, dry food and small tools.

The protective enclosure may be used as the primary support mechanism for an otherwise conventional item of furniture, such as a table or kneehole desk. When incorporated into a table the protective enclosure can serve as a hollow pedestal for supporting the table top. When incorporated into a kneehole desk the protective enclosure can be located within the kneehole space, with side compartments of the enclosure underlying the drawer sections of the desk; the side compartments thus serve as support pedestals for the desk.

THE DRAWINGS

DESCRIPTION OF A PREFERRED EMBODIMENT OF THE INVENTION

Figure 1:
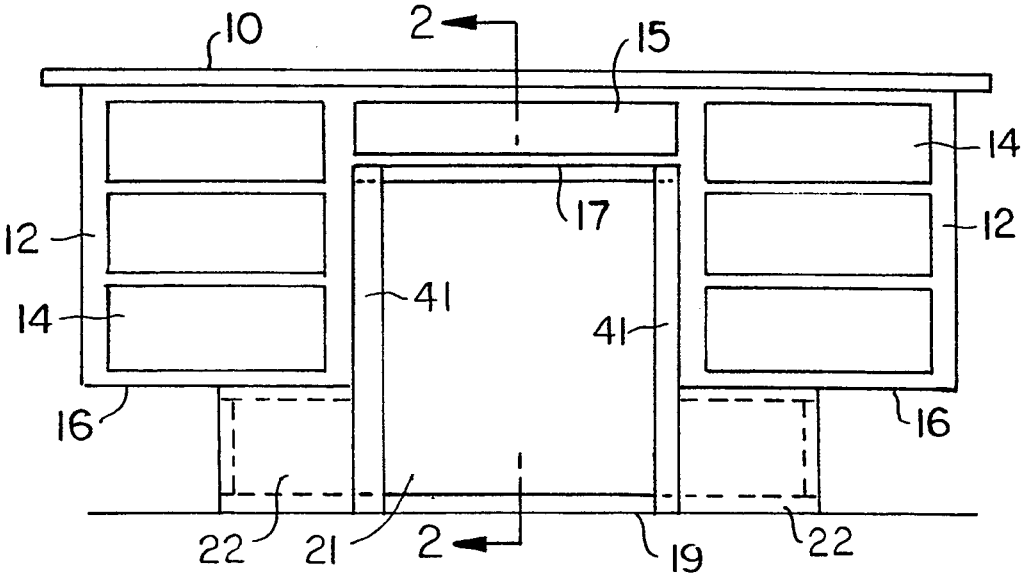
FIG. 1 is a front elevational view of a kneehole desk having a protective enclosure of the present invention incorporated therein.

FIG. 1 is a front elevational view of a kneehole desk that is, for the most part, of standardized construction. As shown, the desk comprises a flat top 10 and two spaced side sections 12; each side section includes three drawers 14. A shallow drawer 15 is located below top 10 in the space between the two sets of drawers 14.

The desk, as thus far described, has two flat lower surfaces 16 at the lower ends of the side sections, and an elevated lower surface 17 below central drawer 15. A protective enclosure 19 of the present invention is arranged below the desk to serve as a support mechanism for the desk.

As shown generally in FIG. 1, the protective enclosure comprises a rectangular housing 21 having an upper flat surface engaged with the central desk undersurface surface 17, and two side compartment structures 22 having upper surfaces thereof engaged with the flat lower surfaces 16 of the desk drawer sections. The protective enclosure thus acts as a support device for the desk structure.

The outer desk structure can be formed of wood e.g., veneer or thin sheet metal according to conventional practice. Protective enclosure 19 may be formed of thicker rigid panels resistant to earthquake forces. During an earthquake event, even though the desk structure might be bent, damaged, or deformed, the protective enclosure 19 will remain intact.

Preferably, the interior structure can e.g., be made of heavy gauge steel which will unite integrally with the outer and the compartment structures.

The construction of enclosure 19 is better shown in FIGS. 2 through 5. As there shown, the enclosure comprises a rectangular housing that includes a floor panel 23, an upstanding rear panel 25, and two side panels 27.

The upper edges of panels 25 and 27 are rigidly attached to a roof wall (or panel) 29.

The front edges of side walls (panels) 27 are spaced apart to define a vertical access opening, designated generally by numeral 31. Two L-shaped tracks extend along the upper edges and front edges of side walls 27 for rollably (slidably) supporting a flexible door 33. Each L-shaped track comprises a horizontal rail 35 extending along the inner surface of each side wall 27 near its upper edge, and a vertical rail 37 extending along the inner surface of each side wall 27 near its front edge; a short curved rail 39 interconnects the two rails 35 and 37 along the inner surface of each side wall 27. Each L-shaped track further comprises a vertical bar 41 secured to the front edge of an associated side wall 27.

Figure 4:
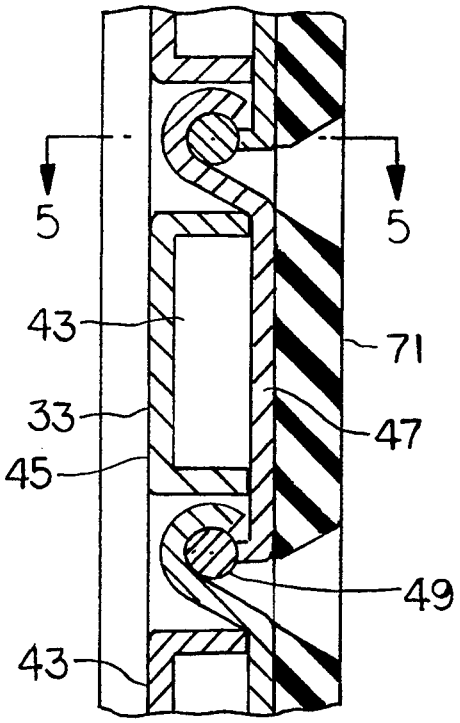
FIG. 4 is a fragmentary transverse sectional view taken through a flexible door that is used in the protective enclosure of FIG. 2.
Figure 5:
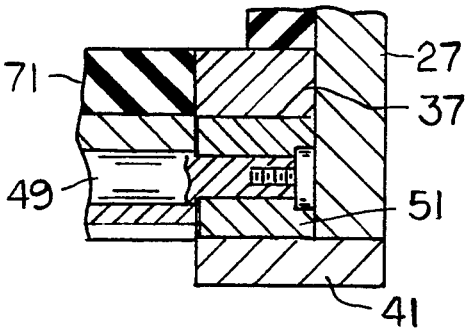
FIG. 5 is a fragmentary sectional view taken on line 5—5 in FIG. 4.
Figure 2:
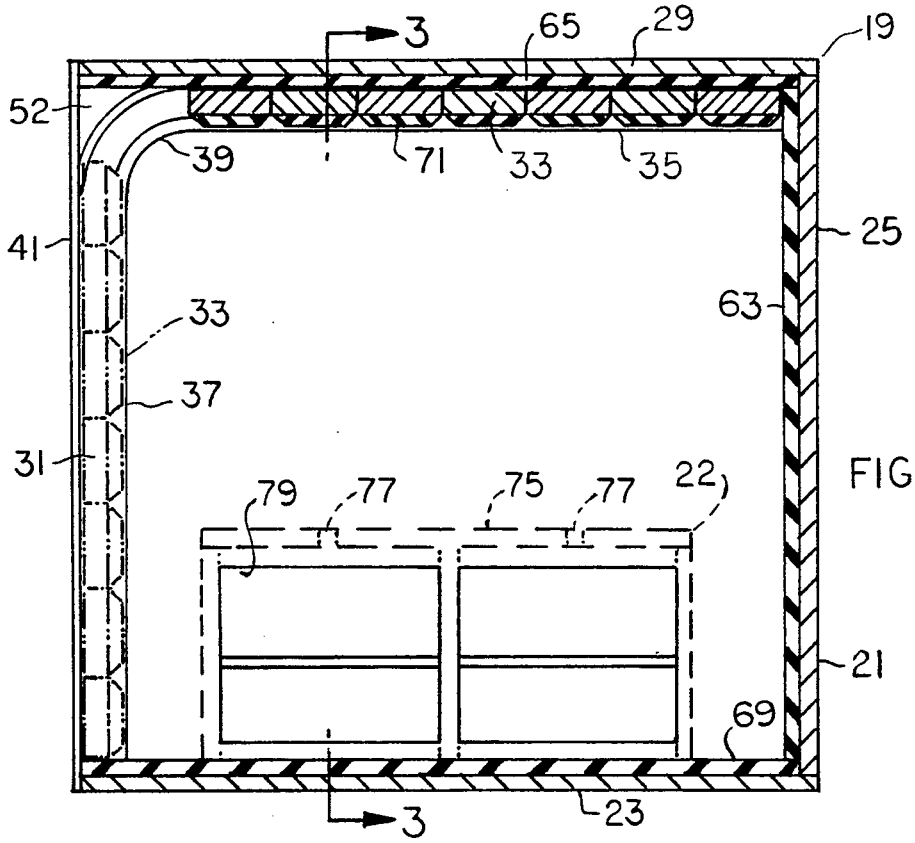
FIG. 2 is a sectional view of the protective enclosure taken on line 2—2 in FIG. 1.

The flexible door comprises a series of rigid slats 43 hingedly connected together; whereby the door can be moved between an open position (shown in full lines in FIG. 2) and a closed position (shown in dashed lines in FIG. 2). The detailed construction of a representative door slat 43, as shown in FIG. 4, comprises a channel 45 welded to a flat plate 47. One edge of each plate 47 is welded to a rod 49 that has machined ends designed to rotatably mount a roller 51 (as shown in FIG. 5). Each roller 51 is located within one of the above-described guidance tracks.

The upper edge portion of each plate 47 has a curled configuration to partially encircle a rod 49 on the adjacent slat, whereby the slats are hingedly connected together for movement of the flexible door between its opened and closed positions. The door may be moved by a person while sitting in a fetal position within protective enclosure 19. As shown in FIG. 2, the length of the flexible door is less than the vertical spacing between floor 23 and roof 29. Therefore, when the door is in its closed position the upper edge of the door is spaced below roof 29 so as to form an air circulation opening 52. A person sitting in the enclosure can breathe freely and also view the area outside the enclosure. Should the enclosure overturn or shift from one location to another location the door will prevent the person from being through out of the enclosure. The various panels that form the enclosure are rigid and resistant to earthquake forces so that the enclosure will not be deformed or brokern apart due to such forces.

Figure 8:
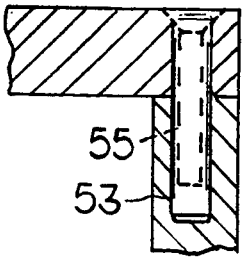
FIG. 8 is a fragmentary sectional view showing a typical corner construction used in the enclosures depicted in FIGS. 2, 3 and 7.

Each panel 23, 25, 27 or 29 can be a relatively thick steel panel having a thickness of about one half inch. Edge areas of the panels can be connected together by welding. FIG. 8 shows an alternate arrangement wherein two representative panels are joined together by a series of dowels 53 and screws 55.

Figure 9:
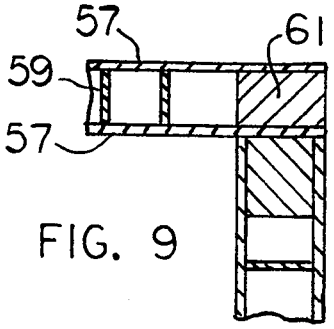
FIG. 9 is a view taken in the same direction as FIG. 8, but showing another corner construction that can be used in practice of the invention

To reduce the weight of the panels, each panel can be comprised of two relatively thin metal sheets sandwiched around a hollow core. As fragmentarily shown in FIG. 9, a representative panel comprises two steel sheets 57 and a honeycomb steel core 59; border areas of the panel are defined by steel bars 61 welded or otherwise attached to sheets 57.

The entire interior surface of the protective enclosure is lined with a resilient cushion material. As shown in the drawing the resilient lining comprises an elastomeric panel 63 secured to the inner surface of rear wall 25, an elastomeric panel 65 secured to the lower surface of roof 29, an elastomeric panel 67 secured to the inner surface of each side wall 27, and an elastomeric panel 69 secured to the upper surface of the floor panel 23; each elastomeric panel covers substantially the entire surface of the associated rigid panel so as to form a resilient cushion around the interior surface of enclosure 19. As shown in FIG. 4, each door slat 43 has a resilient elastomeric pad 71 covering substantially its entire inner surface. The various resilient pads or panels ensure that if the enclosure should overturn or shift abruptly, the body of the person within the enclosure will strike a resilient deformable surface, rather than a hard rigid surface.

Figure 3:
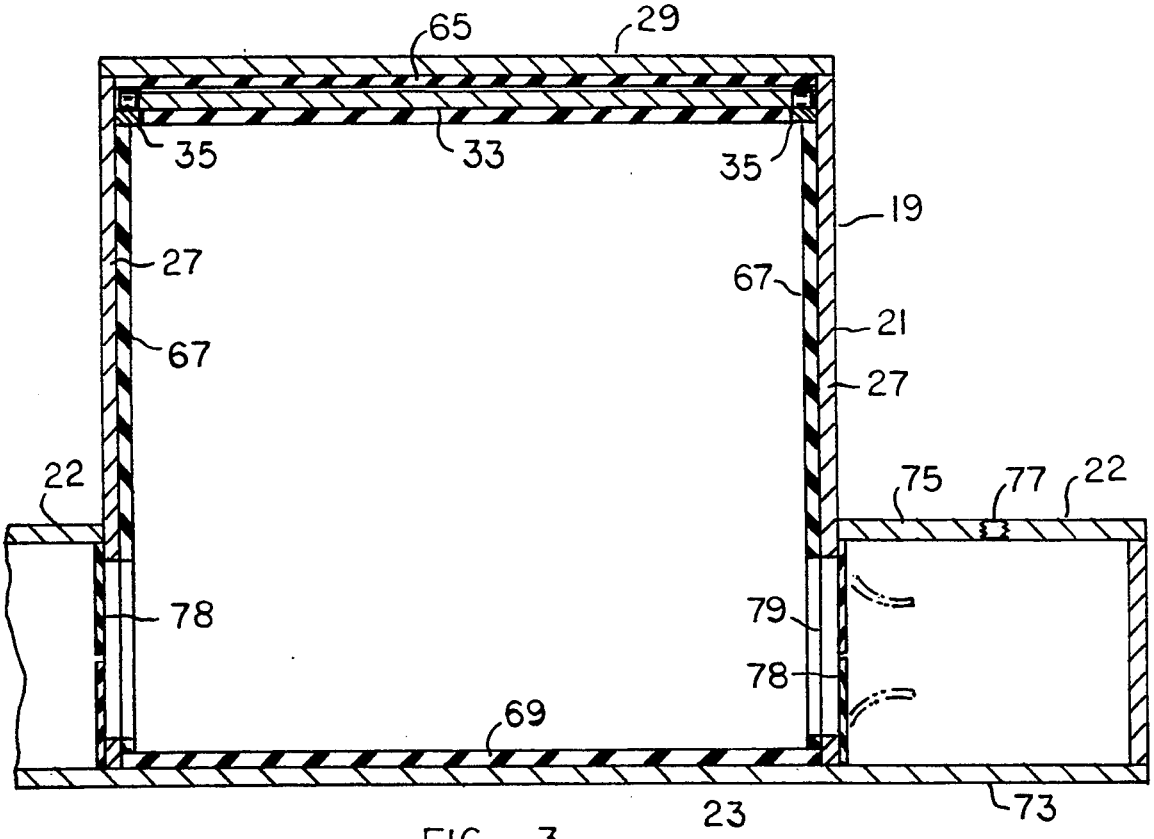
FIG. 3 is a sectional view taken on line 3—3 in FIG. 2.

The construction of each side compartment 22 is shown generally in FIGS. 2 and 3. Each side compartment comprises a series of rigid panels welded or otherwise attached to a side panel 27 and a lateral extension 73 of floor panel 23. The ceiling panel 75 for each side compartment has two threaded holes 76 adapted to receive bolts (not shown) that can be extended through the bottom wall of a desk drawer section, whereby the protective enclosure becomes an integral part of the kneehole desk shown in FIG. 1.

Access to the side compartments is through access holes 79 formed in side wall 27. Each access hole can be closed by two resilient sheet. Material flaps 78 secured to wall 27 along the upper and lower edges of the access hole. The flaps will normally close the access hole; however a person sitting within the protective enclosure can extend his or her hand through the access hole to deflect the flaps and thus gain access to items located in the compartment. The compartments can be used to store emergency items, such as a flashlight, extra batteries, a battery-operated beeper, medicines, bandages, matches bottled water and dry food. The compartment walls will preferably be rigid panels, similar to the panels used for rectangular housing 21.

FIG. 1 shows the protective enclosure in a supportive position underlying the kneehole desk. During normal use of the desk the flexible door 33 will be in its open position, as shown in full lines in FIG. 2. A person sitting in front of the desk will have his or her knees located within the protective housing; the side compartments of the protective enclosure will act as support pedestals for the desk. In an emergency earthquake situation the person can crawl through the access opening 31 to assume a fetal position within housing 21. The flexible door can be pulled to the closed position to provide an essentially complete protective encapsulation of the person. Air circulation opening 52 enables the person to breathe freely and observe conditions outside the enclosure.

Figure 6:
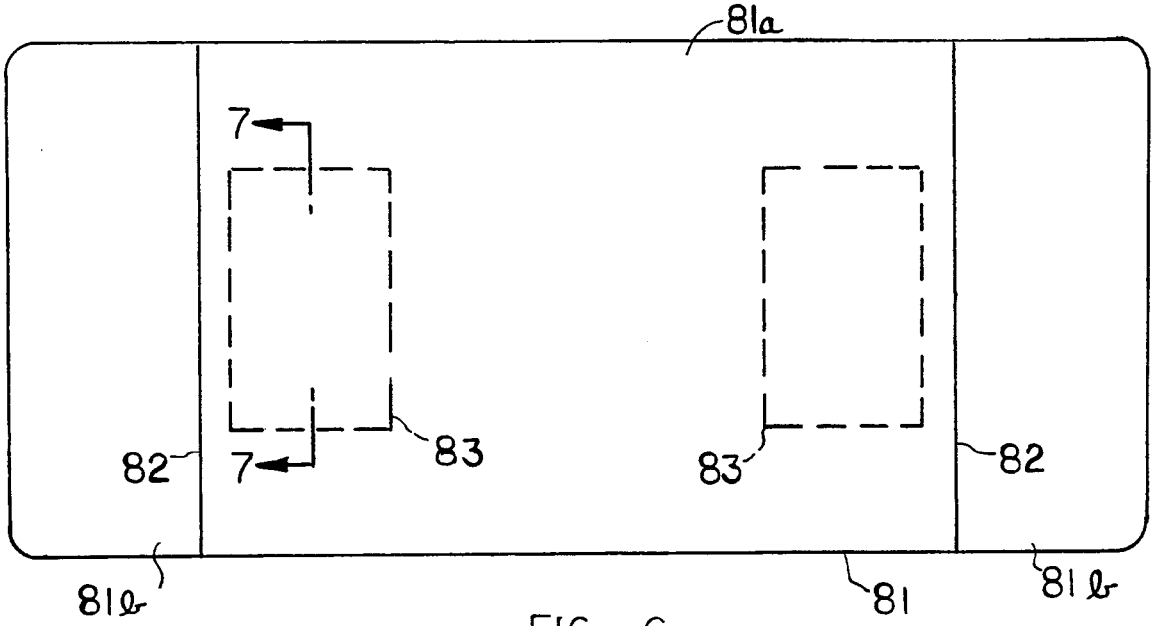
FIG. 6 is a top plan view of a table having a protective enclosure of the present invention incorporated therein.
Figure 7:
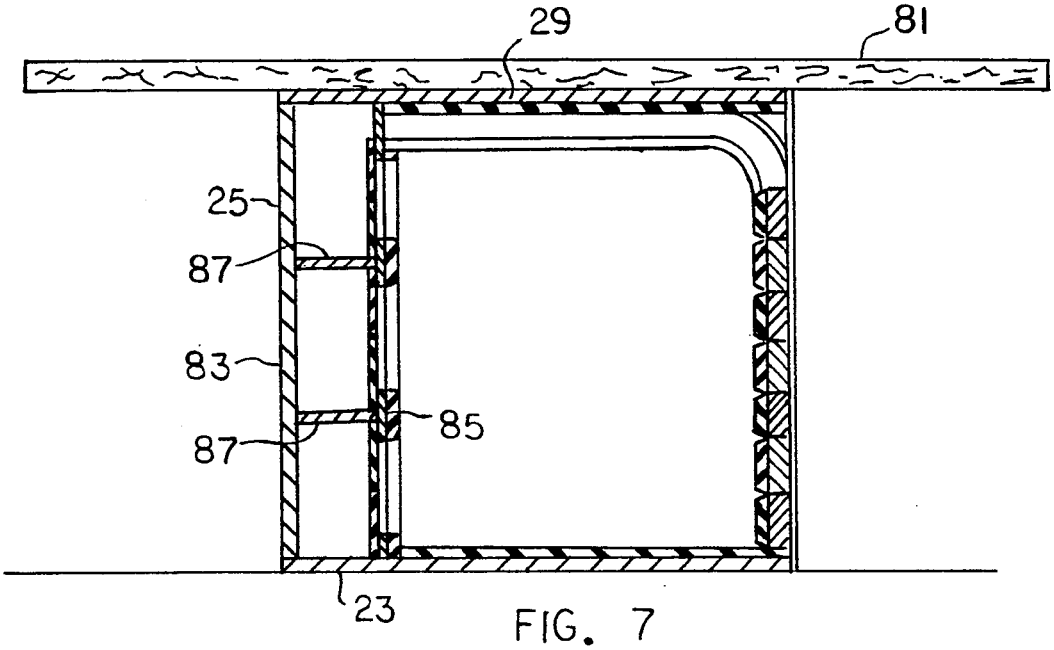
FIG. 7 is a sectional view taken on line 7—7 in FIG. 6.

FIGS. 6 and 7 show a protective enclosure of the present invention incorporated into a table. As shown, the table includes a flat top 81 overlying two protective enclosures 83. Screws or other attachment means, not shown, can be extended through roof 29 of the enclosure into table top 81, such that each enclosure constitutes a supporting pedestal for the table top.

Table top 81 can be a single sheet of material, formed e.g. of wood or metal. Alternately, the table top can be of "drop leaf" construction that includes a central section **81*a* and two end sections 81*b*. Each end section 81*b* has a hinged connection with central top section 81*a*, whereby the end sections can be raised to positions horizontally aligned with section 81*a* or lowered to positions extending downwardly from edges 82** of the central section.

Each enclosure 83 can be constructed generally in the same way as the aforementioned rectangular housing 21. Access to the enclosure is through at least one flexible roll type door similar to the door depicted in FIGS. 4 and 5. Interior surfaces of the enclosure are covered with resilient cushioner panels or pads. As shown in FIG. 7, storage compartments are provided within the rectangular enclosure 83 adjacent the enclosure rear wall 25. A false wall 85 extends between floor panel 23 and roof panel 29 to define the compartment depth dimension. Shelves 87 extend between walls 25 and 85 to support various emergency items.

The protective enclosure can be incorporated into a kneehole desk or into a table, as shown in the drawings. Alternately, the protective enclosure can be a free-standing device usable for storing books, supplies, linens, etc. during normal everyday operations. At the onset of an earthquake any items in the free-standing enclosure can be removed so that the enclosure can be used as a protective enclosure for a human being.

What is claimed is:

1. A protective enclosure for a human during an earthquake, comprising a rectangular housing that includes a floor, rear wall, two side walls, and a roof wall; said floor and said walls being formed of rigid earthquake-resistant panels; said side walls having front edges defining an access opening; two L-shaped door guidance tracks extending along the roof wall and front edges of said side walls; a flexible door spanning said side walls for opening or closing the access opening; said flexible door comprising a plurality of rigid slats hingedly connected together, and a plurality of rollers carried by said slats within said door guidance tracks; said door having an open position extending along the roof wall and a closed position located within the access opening; and resilient cushion means on the inner surfaces of said rear wall, side walls, floor, roof and flexible door, whereby a human being within the housing is at least partially protected from injury during an earthquake.

2. The combination of claim 1, and further comprising an item of furniture at least partly surrounding said rectangular housing, and means for attaching said housing to said furniture item, whereby said housing forms an integral part of the furniture item.

3. The combination of claim 2, wherein said furniture item is a kneehole desk; said rectangular housing being located within the kneehole space of the desk.

4. The combination of claim 3, wherein said housing is oriented so that when said flexible door is in said open position a person sitting in front of the desk will have his or her knees located within the housing.

5. The combination of claim 4, wherein said flexible door has a length dimension that is less than the vertical spacing between the housing floor and the housing roof wall, whereby when the door is in said closed position an upper edge of the door is spaced from the roof wall to thereby form an air circulation space.

6. The combination of claim 5, and further comprising a compartment means extending laterally outwardly from each housing side wall; each compartment means constituting a supporting pedestal for a drawer section of the kneehole desk; each housing side wall having an access hole therein communicating the housing interior space with the space circumscribed by the associated compartment means.

7. The combination of claim 6, wherein each compartment means is defined by a plurality of rigid earthquake-resistant panels; the floor panel of said housing two integral extensions that form floors for the associated compartments.

8. The combination of claim 7, wherein each compartment means comprises a ceiling panel located directly below a desk drawer section; each ceiling panel having a plurality of attachment holes therein; said attaching means comprising attachment bolts extending downwardly from the drawer sections into said attachment holes.

9. The combination of claim 2, wherein said furniture item is a table having a flat top; said rectangular housing being located below said table top whereby the housing constitutes a supporting pedestal for the top.

10. The combination of claim 9, wherein said flexible door has a length dimension that is less than the vertical spacing between the housing floor and the housing roof wall, whereby when the door is in its closed position the upper edge of the door is spaced from the roof wall to thereby form an air circulation space.

11. The combination of claim 10, and further comprising a compartment means located within said housing adjacent the housing rear wall.

12. The combination of claim 1, wherein said flexible door has a length dimension that is less than the vertical spacing between the housing floor and the housing rear wall, whereby when the door is in its closed position the upper edge of the door is spaced from the roof wall to thereby form an air circulation space.

13. The combination of claim 12, wherein the door slats have smooth flat inner surfaces; said resilient cushion means comprising a resilient pad attached to the inner surface of each door slat; each resilient pad having an area substantially coextensive with that of the associated slat.

* * * * *